United States Patent [19]

Kussel et al.

[11] Patent Number: 4,702,148

[45] Date of Patent: Oct. 27, 1987

[54] CONTROL OF THE ACTUATION OF HYDRAULIC CONSUMERS

[75] Inventors: Willy Kussel, Werne; Michael Dettmers, Kamen; Walter Weirich, Dortmund, all of Fed. Rep. of Germany

[73] Assignee: Gewerkschaft Eisenhutte Westfalia GmbH, Lunen, Fed. Rep. of Germany

[21] Appl. No.: 878,154

[22] Filed: Jun. 25, 1986

[30] Foreign Application Priority Data

Aug. 28, 1985 [DE] Fed. Rep. of Germany ..... 3530657

[51] Int. Cl.[4] ..... F15B 11/00

[52] U.S. Cl. ..... 91/527; 91/529; 91/530; 91/471; 137/625.27

[58] Field of Search ..... 91/527, 529, 531, 471; 137/625.27

[56] References Cited

U.S. PATENT DOCUMENTS

| | | | |
|---|---|---|---|
| 2,825,306 | 3/1958 | Buri | 91/527 X |
| 3,016,917 | 1/1962 | Hunt | 137/625.27 |
| 4,046,058 | 9/1977 | Grisebach | 91/529 X |
| 4,105,047 | 8/1978 | Smallwood | 137/625.27 X |
| 4,638,720 | 1/1987 | McKee | 91/529 X |

*Primary Examiner*—Harold W. Weakley

*Attorney, Agent, or Firm*—Sughrue, Mion, Zinn, Macpeak and Seas

[57] ABSTRACT

The invention relates to a method for the simultaneous actuation of a plurality of hydraulic consumers by means of intrinsically-safe electro-hydraulic valves. The consumers are connected by hydraulic directional control valves to a pressure line and/or a return line. These hydraulic directional control valves can be connected in a predetermined manner, via pre-control valves to a control line. The pre-control valves are pressureless, and possess electro-magnets with a current consumption of less than 50 milliamps. By connection of a series-connected electro-hydraulic directional control valve means, the pre-control valves are connected to the control line, and at the same time are hydraulically locked.

13 Claims, 2 Drawing Figures

CONTROL OF THE ACTUATION OF HYDRAULIC CONSUMERS

BACKGROUND TO THE INVENTION

This invention relates to a method of actuating hydraulic consumers by means of intrinsically-safe electro-hydraulic valves, and to an arrangement for controlling the actuation of such hydraulic consumers. In particular, the hydraulic consumers are hydraulic rams used in underground mining installations.

When winning coal in underground longwall mine workings, it is usual to use roof support units to support the roof. These support units include a plurality of hydraulic consumers, such as for example support props, advance rams and roof bar extension rams. The supply of pressurised hydraulic fluid to these consumers is usually controlled by means of electro-hydraulic valves.

Where electrically-actuatable hydraulic control valves are used in firedamp-endangered areas of underground mines, it must be ensured that no firedamp can be ignited by the energy supplied to the valves. The power consumption of such electro-hydraulic control systems is, therefore, correspondingly limited. These control systems have for example a current intensity of 1 to 1:5 amps for an operating voltage of 12 volts.

By reason of the high hydraulic pressure level usual in mining, the electro-hydraulic control valves usually used have a relatively high power consumption of up to 500 milliamps. With the support control systems used hitherto in underground workings, it is not possible to actuate a plurality of electro-hydraulic control valves at the same time. Such valves have to be actuated in sequence.

In the past various attempts have been made to overcome this disadvantage. For example, electro-magnetic valves are known which have a current consumption of about 125 milliamps with a voltage of 12 volts. However, these electro-magnetic valves have a relatively small flow cross-section, and consequently can permit the passage of only small quantities of liquid per unit of time.

A known electrically-actuatable hydraulic control valve has an electric drive mechanism which comprises an energy store in the form of a compression spring. The compression spring is initially compressed by means of a low-power electric geared motor, and liberates the energy stored in the compression spring suddenly for the opening of the valve. (See DE-OS No. 3 123 224).

The aim of the invention is to provide a method of, and an apparatus for, controlling the simultaneous actuation of a plurality of hydraulic consumers in use in a firedamp-endangered surrounding.

SUMMARY OF THE INVENTION

The present invention provides a method of actuating hydraulic consumers, each hydraulic consumer being connected to a hydraulic pressure line by a respective hydraulic directional control valve, wherein each of the hydraulic directional control valves is actuatable to connect the associated hydraulic consumer to the hydraulic pressure line by a respective electro-hydraulic pre-control valve, and wherein the pre-control valves are associated with electro-hydraulic directional control valve means in such a manner that the pre-control valves operate against substantially no hydraulic pressure.

Advantageously, actuation of the electro-hydraulic directional control valve means causes any previously-actuated pre-control valve to be hydraulically locked.

The invention also provides an arrangement for controlling the actuation of hydraulic consumers, the hydraulic consumers being connectible to a hydraulic pressure line, the control arrangement comprising a respective hydraulic directional control valve associated with each of the hydraulic consumers, a respective electro-hydraulic pre-control valve associated with each of the hydraulic directional control valves, and electro-hydraulic directional control valve means associated with the pre-control valves, each of the hydraulic consumers being connected to the hydraulic pressure line via the associated hydraulic directional control valve, wherein each hydraulic directional control valve is actuatable by a control line leading from the output side of the associated pre-control valve, and wherein the input sides of the pre-control valves are connected directly to a hydraulic return line and indirectly, via the electro-hydraulic directional control valve means, to the hydraulic return line or to a hydraulic control line.

Thus, the various hydraulic consumers are connected via their hydraulic directional control valves (3/2-way control valves) directly to the return line and to the pressure line. The hydraulic directional control valves are each held in an initial working postion by a spring, so that the hydraulic consumers are connected to the return line.

The pre-control valves are electrically-actuatable 3/2-way directional control valves. The direct or indirect connection of the input sides of the pre-control valves to the return line ensures that the pre-control valves are "pressureless".

In a preferred embodiment, the arrangement further comprises a control box for actuating the pre-control valves and the electro-hydraulic directional control valve means via electric control leads. Preferably, the pre-control valves are connected to the return line via hydraulic lines.

In order to actuate a plurality of hydraulic consumers at the same time, the corresponding "pressureless" pre-control valves are electrically actuated, for example by keys or the like arranged on the control box. Since actuation of the electro-hydraulic directional control valve means causes the pre-control valves to be hydraulically locked, the electric actuation of the pre-control valves can then be interrupted. The hydraulic directional control valves are then actuated, via their control lines, to connect the selected hydraulic consumers to the pressure line.

Advantageously, the pre-control valves are electro-hydraulic seating valves having electro-magnets whose current consumption is less than 50 milliamps, and preferably is about 10 milliamps.

Preferably, each of the pre-control valves includes a stepped valve stem slidably mounted within a valve sleeve, first and second valve seats, and a valve piston constituting a double valve closure member, the valve piston being formed as a double cone. The electro-magnet of each pre-control valve acts on the stepped valve stem of that valve, the valve stem sliding, sealingly surrounded by a valve sleeve, in a valve guide bush. The valve sleeve and the valve stem together form a hydraulically-loadable annular area having an external diameter D2. The valve piston formed in the style of a double cone is formed on the valve stem on that side thereof remote from the electro-magnet. The cone side of the valve piston pointing in the direction of the electro-magnet, in combination with a corresponding valve seat, forms a hydraulically-loadable annular area with an external diameter D1. The opposite side of the double-cone valve piston lies, when the electro-magnet is energised, on a further valve seat; in this case the hydraulically-loadable annular area has the external diameter D3.

BRIEF DESCRIPTION OF THE DRAWINGS

The invention will now be described in greater detail, by way of example, with reference to the accompanying drawings, in which.

DESCRIPTION OF PREFERRED EMBODIMENTS

Figure 1:
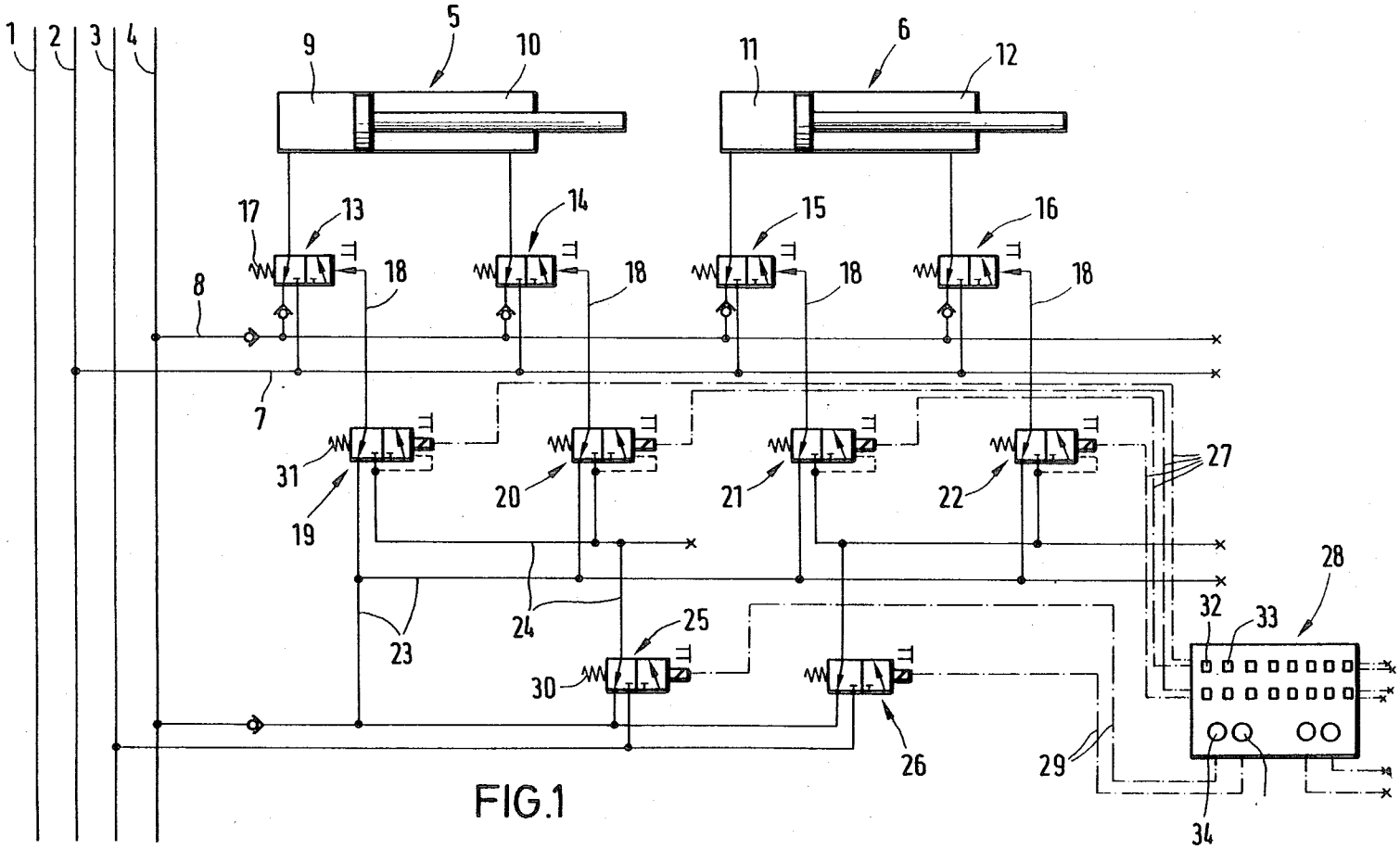
FIG. 1 is a hydraulic circuit diagram of a control arrangement constructed in accordance with the invention.

FIG. 1 shows a hydraulic control arrangement for a mine roof support assembly positioned in a longwall working. The control arrangement is associated with a low pressure line 1, a high pressure line 2, a control line 3 and a return line 4. The lines 1 to 4 pass along the longwall working, and supply the various hydraulic consumers of the mine roof support units which constitute the roof support assembly. FIG. 1 also shows two hydraulic rams 5 and 6 which are controlled by the control arrangement. The rams 5 and 6 are connected, via hydraulic lines 7 and 8 respectively, to the high pressure line 2 and the return line 4. The cylindrical chambers 9 and 11 and the annular working chambers 10 and 12 of the rams 5 and 6 are connected, via 3/2-way directional control valves 13, 14, 15 and 16, to either the high pressure line 2 or the return line 4. The directional control valves 13, 14, 15 and 16 are biassed by springs 17 towards an operational position in which they connect the working chambers 9, 10, 11 and 12 of the rams 5 and 6 to the return line 4. Each directional control valve 13, 14, 15 and 16 has a hydraulic servo-piston (not shown), and is hydraulically actuatable by means of a respective control line 18. On charging of the servo-pistons, the appropriate working chambers 9, 10, 11 and 12 of the rams 5 and 6 are connected to the high pressure line 2.

The control lines 18 are connected to the output sides of pre-control valves 19, 20, 21 and 22, the input sides of these valves being connected, via hydraulic lines 23 and 24, to the return line 4. Further 3/2-way directional control valves 25 and 26 are connected into the hydraulic conduits 24. The pre-control valves 19, 20, 21 and 22 can be actuated by control lines 27; and the directional control valves 25 and 26 can be actuated by control lines 29, from a control box 28.

As may be seen from FIG. 1, the directional control valves 25 and 26 are biassed by springs 30 towards an operational position in which they connect the line 24 to the return line 4. Since, in this position, the lines 23 and 24 are both connected to the return line 4, no hydraulic pressure is present on the input sides of the pre-control valves 19, 20, 21 and 22. The pre-control valves 19, 20, 21 and 22 are biassed by springs 31 towards an operational position in which they connect the control lines 18 to the hydraulic line 23, and thus connect it to the return line 4.

Since the pre-control valves 19, 20, 21 and 22 are operated against no hydraulic pressure, these control valves can incorporate electro-magnets whose current consumption is minimal. In practice, the current consumption of the pre-control valves 19, 20, 21 and 22 can be less than 50 milliamps, and is preferably about 10 milliamps.

The hydraulic control arrangement (which is constituted by the control valves 13 to 16, 19 to 22, 25 and 26 and by the control box 28) works as follows:

With all the valves in the initial position as illustrated, the pre-control valves 19 and 21 are actuated from the control box 28, for example by actuation of keys 32 and 33. The control lines 18 are then connected to the hydraulic line 24, which is still connected to the return line 4. By actuation of the keys 34 and 35, the directional control valves 25 and 26 are actuated to connect the control line 3 to the hydraulic line 24. The control lines 18 are then supplied with pressurised hydraulic fluid, via the pre-control valves 19 and 21, and operate the directional control valves 13 and 15 through their servo-pistons. In this operational position, the cylindrical working chambers 9 and 11 of the rams 5 and 6 are connected to the high pressure line 2, so that the rams are extended.

The pre-control valves 19, 20, 21 and 22 are hydraulically self-locking, which means that, as soon as pressure is present in the hydraulic line 24, the electric actuation of the pre-control valves can be interrupted. The pre-control valves 19, 20, 21 and 22 remain hydraulically locked as long as the directional control valves 25 and 26 are electrically charged by way of the keys 34 and 35.

Figure 2:
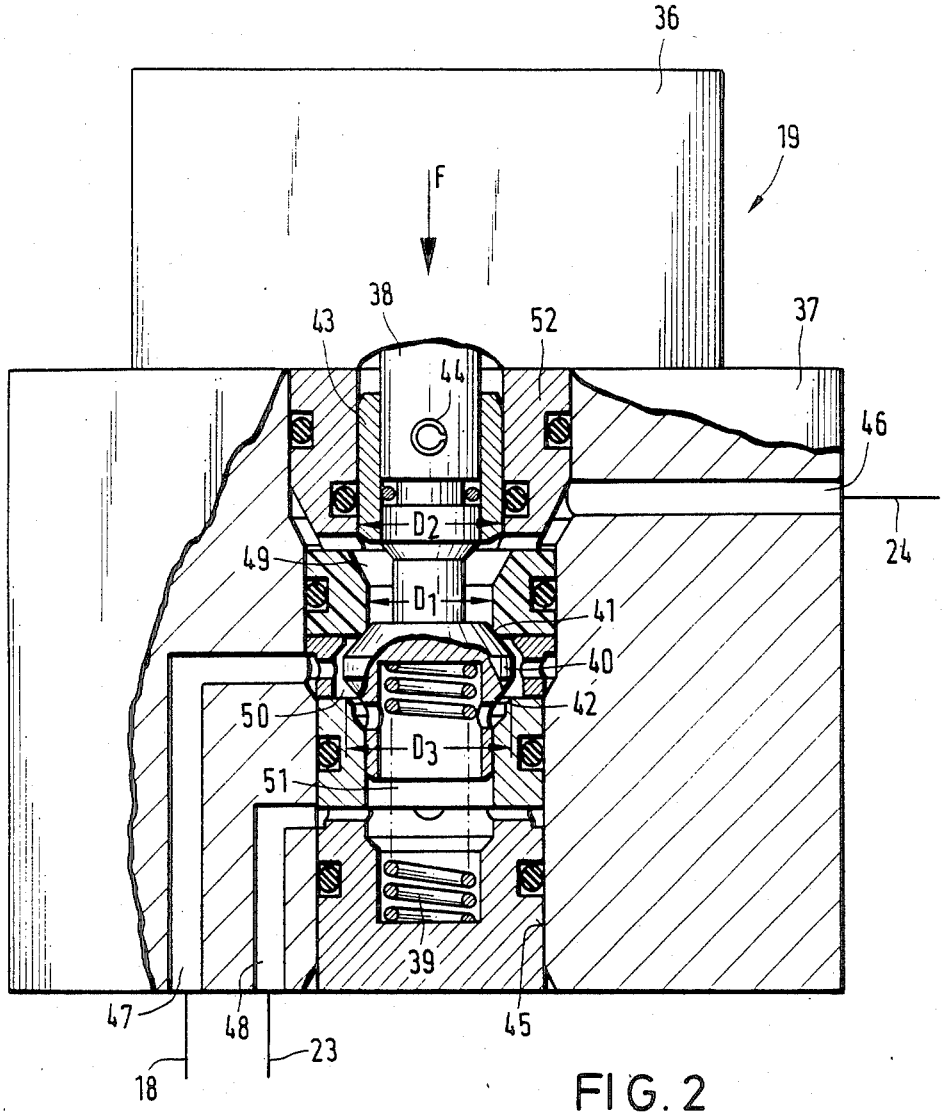
FIG. 2 is a part-sectional elevation of a pre-control valve forming part of the arrangement of FIG. 1.

The pre-control valves 19, 20, 21 and 22 are identical, and so the constructional details of only one of these (the valve 19) will now be described with reference to FIG. 2. Thus, the pre-control valve 19 consists of an actuator 36, in which an electro-magnet (not shown) is arranged, and of a hydraulic control part 37. The actuator 36 is screwed on to the control part 37, or the two components are arranged in one common housing.

The control pulse triggered in the actuator 36 by the electro-magnet acts upon a valve stem 38 in the direction of the arrow F, and shifts the valve stem against the force of a valve spring 39. The valve stem 38 is of multi-stepped construction, and its upper region is surrounded by a sealingly-abutting valve sleeve 43. The valve sleeve 43 is fixed by a clamping sleeve 44 to the valve stem 38, and slides in a valve guide bush 52. At its end opposite to the electro-magnet, the valve stem 38 is provided with a piston 40. The valve piston 40 is of double conical construction so as to define upper and lower cone seats. When the electro-magent is not energised, the upper cone seat is pressed by the valve spring 39 against an upper valve seat 41. When the electro-magnet is energised, that is to say when the valve stem 38 is shifted downwards against the force of the valve spring 39, the lower cone seat of the valve piston 40 is forced against a lower valve seat 42. The control part 37 has a central reception bore 45, which receives the valve stem 38, and bores 46, 47 and 48. The bore 46 is connected to the hydraulic line 24, the bore 47 is connected to the control line 18, and the bore 48 is connected to the hydraulic line 23.

If the pre-control valve 19 is supplied with pressurised hydraulic fluid via the hydraulic line 24 and the bore 46 (that is to say when the directional control valve 25 has been operated) without its electro-magnet having previously been energised, then the hydraulic fluid present in the valve antechamber 49 acts upon an upper annular area of the valve piston 40, the annular area having an external diameter D1. The hydraulic fluid in the valve antechamber 49 also acts upon the lower end of the valve sleeve 43, and thus generates an oppositely-acting force component. Since the annular area having an external diameter D2 which is defined by the valve sleeve 43, is larger than the annular area with the external diameter D1, the valve piston 40 is pressed more firmly against the valve seat 41. In this operational position, the pre-control valve 19 is closed in relation to the control line 3. The control line 18 is connected to the hydraulic line 23 and thus to the return line 4.

If the pre-control valve 19 is actuated, its electro-magnet forces the valve piston 40 against the lower valve seat 42. In this case, the valve piston 40 is pressurised by the.hydraulic fluid supplied by the line 24, on an upper annular area having an external diameter D3. Since the external diameter D3 is larger than the external diameter D2, the pressurised upper annular area of the valve piston 40 is larger than the annular area effective on the valve sleeve 43, so that the valve piston will be pressed by the hydraulic pressure against the lower valve seat 42 and held fast there, even when the electro-magnet is switched off. In this operational position, the hydraulic line 24 is connected to the control line 18. This operational position is released only when the directional control valve 25 is switched off.

We claim:

1. A method of actuating hydraulic consumers, each hydraulic consumer being connected to a hydraulic pressure line by a respective hydraulic directional control valve, wherein each of the hydraulic directional control valves is actuatable to connect the associated hydraulic consumer to the hydraulic pressure line by a respective electro-hydraulic pre-control valve, and wherein the pre-control valves are associated with electro-hydraulic directional control valve means in such a manner that the pre-control valves operate against substantially no hydraulic pressure.

2. A method according to claim 1, wherein actuation of the electro-hydraulic directional control valve means causes any previously-actuated pre-control valve to be hydraulically locked.

3. An arrangement for controlling the actuation of hydraulic consumers, the hydraulic consumers being connected to a hydraulic pressure line, the control arrangement comprising a respective hydraulic directional control valve associated with each of the hydraulic consumers, a respective electro-hydraulic pre-control valve associated with each of the hydraulic directional control valves, and electro-hydraulic directional control valve means associated with the pre-control valves, each of the hydraulic consumers being connected to the hydraulic pressure line via the associated hydraulic directional control valve, wherein each hydraulic directional control valve is actuated by a control line leading from the output side of the associated pre-control valve, and wherein the input sides of the pre-control valves are connected directly to a hydraulic return line and indirectly, via the electro-hydraulic directional control valve means, to the hydraulic return line or to a hydraulic control line.

4. An arrangement according to claim 3, further comprising a control box for actuating the pre-control valves and the electro-hydraulic directional control valve means via electric control leads.

5. An arrangement according to claim 3, wherein, in a first operating position, the input sides of the pre-control valves are connected to the return line via hydraulic lines.

6. An arrangement according to claim 3, wherein the pre-control valves are electro-hydraulic seating valves having electro-magnets whose current consumption is less than 50 milliamps.

7. An arrangement according to claim 6, wherein the current consumption of the electro-magnets of the pre-control valves is about 10 milliamps.

8. An arrangement according to claim 3, wherein each of the pre-control valves includes a stepped valve stem slidably mounted within a valve sleeve, first and second valve seats, and a valve piston constituting a double valve closure member, the valve piston being formed as a double cone.

9. An arrangement according to claim 8, wherein the pressure-loaded annular area, of external diameter D2, formed by the valve sleeve of each pre-control valve, is larger than the annular area of the associated valve piston, of external diameter D1, effective on the associated first valve seat.

10. An arrangement according to claim 8, wherein the annular area of the valve piston of each pre-control valve, of external diameter D3, effective on the associated second valve seat is larger than the annular area of external diameter D2 defined by the associated valve sleeve.

11. An arrangement according to claim 8, wherein each pre-control valve has a valve antechamber connected via a connection bore to a hydraulic line leading to the electro-hydraulic directional control valve means, a valve chamber connected via a connection bore to the associated control line, and a spring chamber connected via a connection bore and a hydraulic line to the return line.

12. An arrangement according to claim 3, wherein each of the hydraulic consumers is a working chamber of a hydraulic ram.

13. An arrangement according to claim 12, wherein a plurality of electro-hydraulic directional control valves constitute the electro-hydraulic directional control valve means, each electro-hydraulic directional control valve being associated with the two pre-control valves associated with the two working chambers of a respective hydraulic ram.

* * * * *